US009075383B2

(12) United States Patent
Sengoku et al.

(10) Patent No.: US 9,075,383 B2
(45) **Date of Patent: *Jul. 7, 2015**

(54) IMAGE FORMING APPARATUS

(71) Applicant: RICOH COMPANY, LTD., Ohta-ku (JP)

(72) Inventors: Kenji Sengoku, Kanagawa (JP); Hiroyoshi Haga, Kanagawa (JP); Hiromi Ogiyama, Tokyo (JP); Yasunobu Shimizu, Kanagawa (JP); Tomokazu Takeuchi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/167,408

(22) Filed: Jan. 29, 2014

(65) Prior Publication Data

US 2014/0147182 A1 May 29, 2014

Related U.S. Application Data

(63) Continuation of application No. 13/417,637, filed on Mar. 12, 2012, now Pat. No. 8,682,231.

(30) Foreign Application Priority Data

Mar. 18, 2011 (JP) ..... 2011-061000

(51) Int. Cl.

| | |
|---|---|
| ***G03G 15/16*** | (2006.01) |
| ***G03G 21/00*** | (2006.01) |
| ***G03G 15/00*** | (2006.01) |
| ***G03G 15/01*** | (2006.01) |

(52) U.S. Cl.

CPC ..... *G03G 21/0023* (2013.01); *G03G 15/161* (2013.01); *G03G 15/1675* (2013.01); *G03G15/5058* (2013.01); *G03G 2215/0129* (2013.01); *G03G 2215/1661* (2013.01); *G03G 15/0131* (2013.01)

(58) Field of Classification Search

USPC ..... 399/99, 100, 101, 129, 264, 296, 354

See application file for complete search history.

(56) References Cited

U.S. PATENT DOCUMENTS

| | | | |
|---|---|---|---|
| 5,541,708 | A | 7/1996 | Tsuruoka |
| 2009/0190951 | A1 | 7/2009 | Torimaru et al. |

FOREIGN PATENT DOCUMENTS

| | | |
|---|---|---|
| JP | 2003-330289 | 11/2003 |
| JP | 2005-242009 | 9/2005 |
| JP | 2006-267486 | 10/2006 |
| JP | 2007-304335 | 11/2007 |

OTHER PUBLICATIONS

Office Action issued Dec. 26, 2014 in Japanese Patent Application No. 2011-061000.

*Primary Examiner* — David Bolduc
*Assistant Examiner* — Barnabas Fekete
(74) *Attorney, Agent, or Firm* — Oblon, McClelland, Maier & Neustadt, L.L.P.

(57) ABSTRACT

An image forming apparatus includes an image bearing member, an image forming unit for forming a toner image and a toner pattern comprising toner not to be transferred onto a recording medium for adjustment of a density of toner on a surface of the image bearing member, a nip forming member contacting the surface of the image bearing member to form a transfer nip therebetween, a transfer bias applicator for applying a transfer bias in which an alternating current component and a direct current component are superimposed to transfer the toner image onto the recording medium in the transfer nip, a first cleaning device to mechanically remove toner remaining on the image bearing member after passing through the transfer nip. The transfer bias applicator applies a charge eliminating bias to remove charge from toner in the toner pattern when the toner pattern passes through the transfer nip.

27 Claims, 5 Drawing Sheets

SECONDARY TRANSFER: DC VOLTAGE ONLY

SECONDARY TRANSFER: DC+AC VOLTAGE

SECONDARY TRANSFER: AC VOLTAGE ONLY

IMAGE FORMING APPARATUS

CROSS-REFERENCE TO RELATED APPLICATION

This application is a continuation application of U.S. application Ser. No. 13/417,637, filed Mar. 12, 2012, which claims priority pursuant to 35 U.S.C. §119 to Japanese Patent Application No. 2011-061000, filed on Mar. 18, 2011 in the Japanese Patent Office. The entire contents of the above-identified applications are incorporated herein by reference.

BACKGROUND OF THE INVENTION

1. Field of the Invention

Exemplary aspects of the present disclosure generally relate to an image forming apparatus, such as a copier, a facsimile machine, a printer, or a multi-functional system including a combination thereof.

2. Description of the Related Art

Related-art image forming apparatuses, such as copiers, facsimile machines, printers, or multifunction printers having at least one of copying, printing, scanning, and facsimile capabilities, typically form an image on a recording medium according to image data. Thus, for example, a charger uniformly charges a surface of an image bearing member (which may, for example, be a photoconductive drum); an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

The image forming apparatus using an intermediate transfer method employs a belt-type intermediate transfer member (hereinafter referred to simply as intermediate transfer belt) formed into an endless loop that contacts the photoconductive drum, forming a primary transfer nip therebetween. In the primary transfer nip, a toner image formed on the photoconductive drum is transferred primarily onto the intermediate transfer belt. This process is known as "primary transfer process".

A secondary transfer roller contacts the intermediate transfer belt, forming a secondary transfer nip, so that the toner image on the intermediate transfer belt is secondarily transferred onto a recording medium in a process known as "secondary transfer process". A secondary transfer counter roller is disposed inside the loop formed by the intermediate transfer belt, facing the secondary transfer roller with the intermediate transfer belt interposed therebetween.

The secondary transfer counter roller disposed inside the loop of the intermediate transfer belt is grounded; whereas, the secondary transfer roller disposed outside the loop is supplied with a secondary transfer bias. With this configuration, a secondary transfer electric field that electrostatically transfers the toner image from the secondary transfer counter roller side to secondary transfer roller side is formed. The toner image on the intermediate transfer belt is transferred secondarily onto a recording medium supplied to the secondary transfer nip in appropriate timing such that the recording medium is aligned with the toner image formed on the intermediate transfer belt.

When using a recording medium having a coarse surface such as Japanese paper, a pattern of light and dark according to the surface condition of the recording medium appears in an output image. More specifically, toner is transferred poorly to recessed portions on the surface of the recording medium. As a result, the density of toner at the recessed portions is less than that of projecting portions. In view of the above, in a known image forming apparatus, a secondary bias composed only of a direct current voltage is not used, but a bias in which a direct current voltage is superimposed on an alternating current voltage is supplied, thereby preventing the pattern of light and dark, as compared with supplying only the direct current voltage.

In general, known image forming apparatuses produce a test image known as a toner pattern to achieve target image quality. For example, the toner pattern is formed on the intermediate transfer belt at specific times for example, between successive recording media sheets. Then, an optical detector detects the toner pattern. Based on the result detected by the optical detector, image quality control such as adjustment of the density of the image and correction of color drift are performed. Furthermore, the toner pattern is formed between successive recording media sheets to replace spent toner in a developing device with fresh toner to maintain imaging quality.

When performing the image quality control, the secondary transfer roller is separated from the intermediate transfer belt so that the toner pattern formed on the intermediate transfer belt is not transferred onto a recording medium. Instead, the toner pattern is removed by a cleaning device, for example, a cleaning blade.

The cleaning device needs to adequately remove toner of the toner pattern from the intermediate transfer belt. Otherwise, the toner remaining on the intermediate transfer belt may stick to a successive recording medium. However, when a large amount of toner is adhered to the toner pattern on the intermediate transfer belt, it is difficult to remove the toner from the intermediate transfer belt thoroughly.

Similarly, in an image forming apparatus using a direct transfer method in which the toner image is directly transferred from the photoconductive drum to a recording medium, the toner in the toner pattern formed on the photoconductive drum may not be removed thoroughly.

In view of the above, there is demand for an image forming apparatus that is capable of adequately removing a toner pattern.

BRIEF SUMMARY

In view of the foregoing, in an aspect of this disclosure, an image forming apparatus includes an image bearing member, an image forming unit, a nip forming member, a transfer bias applicator, and a first cleaning device. The image bearing member bears a toner image and a toner pattern which comprises toner not to be transferred onto a recording medium for adjustment of a density of toner on an image bearing surface of the image bearing member. The image forming unit is disposed opposite the image bearing member, to form the toner image and the toner pattern on the image bearing surface of the image bearing member. The toner pattern is formed on the image bearing member at predetermined timing. The nip forming member contacts the image bearing surface of the image bearing member to form a transfer nip therebetween. The transfer bias applicator supplies a transfer bias in which an alternating current component and a direct current component are superimposed to transfer the toner image onto a recording medium in the transfer nip. The transfer bias applicator supplies a charge eliminating bias to remove charge from toner in the toner pattern when the toner pattern passes through the transfer nip. The first cleaning device mechanically removes toner remaining on the image bearing member after passing through the transfer nip.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF DISCLOSED EMBODIMENTS

Figure 1:
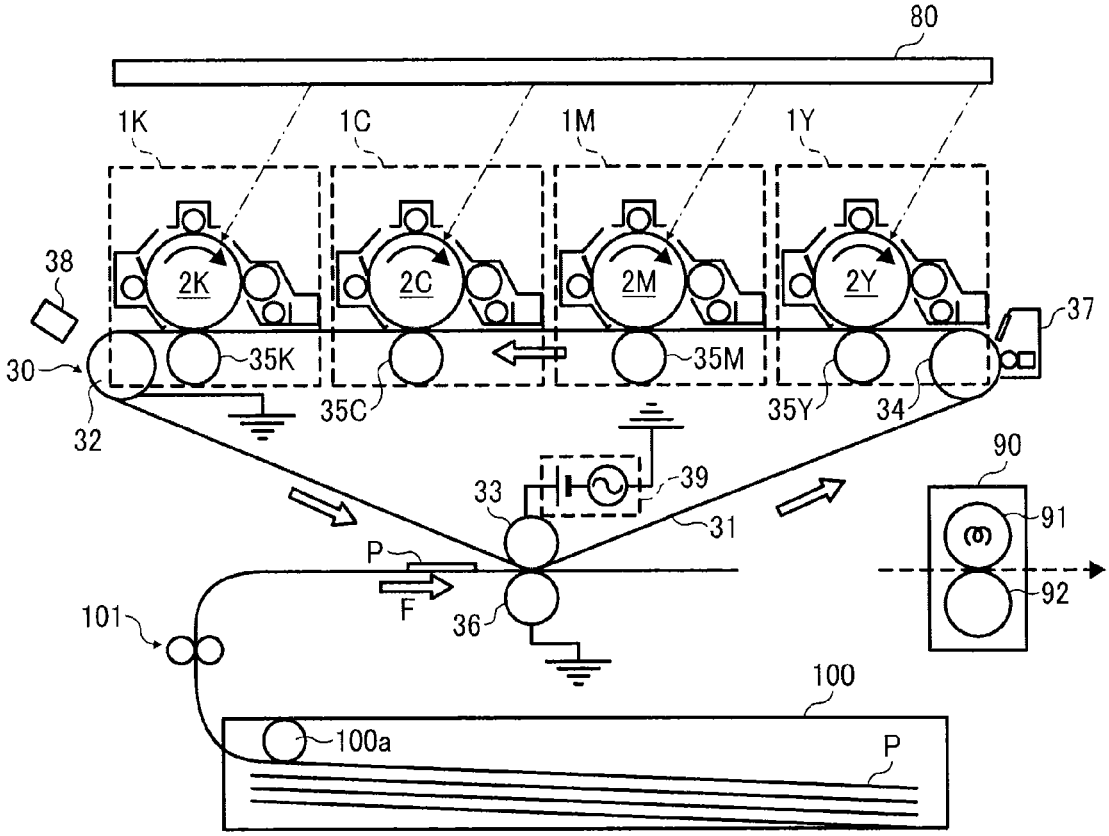
FIG. 1 is a schematic diagram illustrating a printer as an example of an image forming apparatus, according to an illustrative embodiment of the present invention.

A description is now given of illustrative embodiments of the present application. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially with reference to FIG. 1, a description is provided of an image forming apparatus according to an aspect of this disclosure.

FIG. 1 is a schematic diagram illustrating a color printer as an example of the image forming apparatus according to an illustrative embodiment of the present invention. As illustrated in FIG. 1, the image forming apparatus includes four image forming units 1Y, 1M, 1C, and 1K for forming toner images, one for each of the colors yellow, magenta, cyan, and black, respectively, a transfer unit 30, an optical writing unit 80, a fixing device 90, a sheet cassette 100, and a pair of registration rollers 101. The order of image forming units 1Y, 1M, 1C, and 1K is not limited to this order.

It is to be noted that the suffixes Y, M, C, and K denote colors yellow, magenta, cyan, and black, respectively. To simplify the description, these suffixes Y, M, C, and K indicating colors are omitted herein, unless otherwise specified.

The optical writing unit 80 is disposed substantially above the image forming units 1Y, 1M, 1C, and 1K. The sheet cassette 100 is disposed at the bottom of the image forming apparatus. The fixing device 90 is disposed downstream from the transfer unit 30 in the direction of transport of the recording medium indicated by a hollow arrow.

The image forming units 1Y, 1M, 1C, and 1K all have the same configuration as all the others, differing only in the color of toner employed. Thus, a description is provided of the image forming unit 1K for forming a toner image of black as a representative example of the image forming units 1. The image forming units 1Y, 1M, 1C, and 1K are replaced upon reaching their product life cycles.

Figure 2:
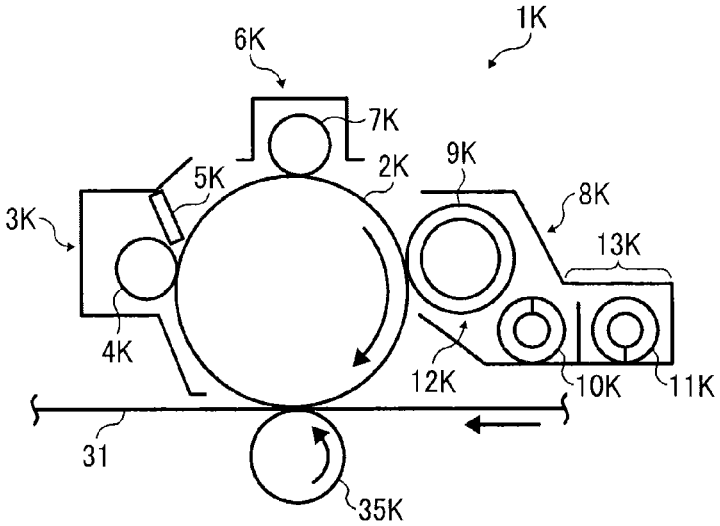
FIG. 2 is a schematic diagram illustrating an image forming unit for black as an example of image forming units employed in the image forming apparatus of FIG. 1.

With reference to FIG. 2, a description is provided of the image forming unit 1K as an example of the image forming units 1. FIG. 2 is a schematic diagram illustrating the image forming unit 1K. A photoconductive drum 2K serving as a latent image bearing member is surrounded by various pieces of imaging equipment, such as a charging device 6K, a developing device 8K, a drum cleaner 3K, and a charge neutralizing device (not illustrated). These devices are held by a common holder so that they are detachably attachable and replaced at the same time.

The photoconductive drum 2K comprises a drum-shaped base on which an organic photoconductive layer is disposed, with the external diameter of approximately 60 mm. The photoconductive drum 2K is rotated in a clockwise direction by a driving device. The charging device 6K includes a charging roller 7K supplied with a charging bias. The charging roller 7K contacts or approaches the photoconductive drum 2K to generate an electrical discharge therebetween, thereby charging uniformly the surface of the photoconductive drum 2K.

According to an illustrative embodiment, the photoconductive drum 2K is uniformly charged with a negative polarity which is the same charging polarity as toner. As the charging bias, an alternating current voltage superimposed on a direct current voltage is employed. The charging roller 7K comprises a metal cored bar coated with a conductive elastic layer made of a conductive elastic material. According to the present embodiment, the photoconductive drum 2K is charged by the charging roller 7K contacting the photoconductive drum 2K or disposed near the photoconductive drum 2K. Alternatively, a corona charger may be employed.

The uniformly charged surface of the photoconductive drum 2K is scanned by a light beam projected from the optical writing unit 80, thereby forming an electrostatic latent image for black on the surface of the photoconductive drum 2K. The electrostatic latent image for black on the photoconductive drum 2K is developed with black toner by the developing device 8K. Accordingly, a visible image, also known as a toner image, of black, is formed. As will be described later, the toner image is transferred primarily onto an intermediate transfer belt 31.

The drum cleaner 3K removes residual toner remaining on the photoconductive drum 2K after the primary transfer process, that is, after the photoconductive drum 2K passes through a primary transfer nip between the intermediate transfer belt 31 and the photoconductive drum 2K. The drum cleaner 3K includes a brush roller 4K and a cleaning blade 5K. The cleaning blade 5K is cantilevered, that is, one end of the cleaning blade is fixed to the housing of the drum cleaner 3K, and its free end contacts the surface of the photoconductive drum 2K.

The brush roller 4K rotates and brushes off the residual toner from the surface of the photoconductive drum 2K while the cleaning blade 5K removes the residual toner by scraping. It is to be noted that the cantilevered side of the cleaning blade 5K is positioned downstream from its free end contacting the photoconductive drum 2K in the direction of rotation of the photoconductive drum 2K so that the free end of the cleaning blade 5K faces or becomes counter to the direction of rotation.

The charge neutralizer removes residual charge remaining on the photoconductive drum 2K after the surface thereof is cleaned by the drum cleaner 3K in preparation for the subsequent imaging cycle. The surface of the photoconductive drum 2K is initialized.

The developing device 8K includes a developing portion 12K and a developer conveyer 13K. The developing portion 12K includes a developing roller 9K inside thereof. The developer conveyer 13K mixes a developing agent for black and transports the developing agent. The developer conveyer 13K includes a first chamber equipped with a first screw 10K and a second chamber equipped with a second screw 11K. The first screw 10K and the second screw 11K are each constituted of a rotatable shaft and helical flighting wrapped around the circumferential surface of the shaft. Each end of the shaft of the first screw 10K and the second screw 11K are rotatably held by shaft bearings.

The first chamber with the first screw 10K and the second chamber with the second screw 11K are separated by a wall, but each end of the wall in the direction of the screw shaft has a connecting hole through which the first chamber and the second chamber are connected. The first screw 10K mixes the developing agent by rotating the helical flighting and carries the developing agent from the distal end to the proximal end of the screw in the direction perpendicular to the surface of the recording medium. The first screw 10K and the developing roller 9K are disposed facing and parallel to one another. Hence, the direction of transport of the developing agent is along the axial (shaft) direction of the developing roller 9K. The first screw 10K supplies the developing agent to the surface of the developing roller 9K along the direction of the shaft line of the developing roller 9K.

The developing agent transported near the proximal end of the first screw 10K passes through the connecting hole in the wall near the proximal side and enters the second chamber. Subsequently, the developing agent is carried by the helical flighting of the second screw 11K. As the second screw 11K rotates, the developing agent is transported from the proximal end to the distal end in FIG. 2 while being mixed in the direction of rotation.

In the second chamber, a toner detector for detecting a density of toner in the developing agent is disposed at the bottom of a casing of the chamber. As the toner detector, a magnetic permeability detector may be employed. There is a correlation between the toner density and the magnetic permeability of the developing agent consisting of a toner and a magnetic carrier. Therefore, the magnetic permeability detector detects the density of the toner.

Although not illustrated, the image forming apparatus includes toner supply devices to independently supply toner of yellow, magenta, cyan, and black to the second chamber of the respective developing device 8. A controller of the image forming apparatus includes a Random Access Memory (RAM) to store a target output voltage Vtref for yellow, magenta, cyan, and black, provided by the toner detector. If a difference between the output voltage provided by the toner detectors and Vtref for each color exceeds a predetermined value, the toner supply devices are driven for a predetermined time period corresponding to the difference. Accordingly, the respective color of toner is supplied to the second chamber of the developing device 8.

The developing roller 9K in the developing portion 12K faces the first screw 10K and also the photoconductive drum 2K through an opening formed in the casing of the developing device 8K. The developing roller 9K comprises a developing sleeve made of a non-magnetic pipe which is rotated, and a magnetic roller disposed inside the developing sleeve such that the magnetic roller is fixed to prevent the magnetic roller from rotating together with the developing sleeve.

The developing agent supplied from the first screw 10K is carried on the surface of the developing sleeve by the magnetic force of the magnetic roller. As the developing sleeve rotates, the developing agent is transported to a developing area facing the photoconductive drum 2K.

The developing sleeve is supplied with a developing bias having the same polarity as toner. The developing bias is greater than the bias of the electrostatic latent image on the photoconductive drum 2K, but less than the charging potential of the uniformly charged portion of the photoconductive drum 2K. With this configuration, a developing potential that causes the toner on the developing sleeve to move electrostatically to the electrostatic latent image on the photoconductive drum 2K is formed between the developing sleeve and the electrostatic latent image on the photoconductive drum 2K.

A non-developing potential acts between the developing sleeve and the non-image portion of the photoconductive drum 2K so that the toner on the developing sleeve to the sleeve surface. Due to the developing potential and the non-developing potential, the black toner on the developing sleeve moves selectively to the electrostatic latent image formed on the photoconductive drum 2K, thereby forming a visible image, known as a toner image of black.

Similar to the image forming unit 1K, toner images of yellow, magenta, and cyan are formed on the photoconductive drums 2Y, 2M, and 2C of the image forming units 1Y, 1M, and 1C, respectively.

The optical writing unit 80 for writing a latent image on the photoconductive drums 2 is disposed above the image forming units 1Y, 1M, 1C, and 1K. Based on image information received from an external device such as a personal computer (PC), the optical writing unit 80 illuminates the photoconductive drums 2 with a light beam projected from a laser diode of the optical writing unit 80. Accordingly, the electrostatic latent images of yellow, magenta, cyan, and black are formed on the photoconductive drums 2Y, 2M, 2C, and 2K, respectively.

More specifically, the potential of the portion of the charged surface of the photoconductive drum 2 illuminated with the light beam is attenuated. The potential of the illuminated portion of the photoconductive drum 2 is less than the potential of the other area, that is, the background portion (non-image portion), thereby forming the electrostatic latent image on the photoconductive drum 2.

The optical writing unit 80 includes a polygon mirror, a plurality of optical lenses, and mirrors. The light beam projected from the laser diode serving as a light source is deflected in a main scanning direction by the polygon mirror rotated by a polygon motor. The deflected light, then, strikes the optical lenses and mirrors, thereby scanning the photoconductive drum 2. The optical writing unit 80 may employ a light source using an LED array including a plurality of LEDs that projects light.

Referring back to FIG. 1, a description is provided of the transfer unit 30. The transfer unit 30 is disposed below the image forming units 1Y, 1M, 1C, and 1K. The transfer unit 30 includes the intermediate transfer belt 31 serving as an image bearing member formed into an endless loop and rotated in the counterclockwise direction. The transfer unit 30 also includes a driving roller 32, a secondary-transfer rear roller 33, a cleaning backup roller 34, an nip forming roller 36, a belt cleaning device 37, an electric potential detector 38, four primary transfer rollers 35Y, 35M, 35C, and 35K, and so forth.

The intermediate transfer belt 31 is entrained around and stretched taut between the driving roller 32, the secondary-transfer rear roller 33, the cleaning backup roller 34, and the primary transfer rollers 35Y, 35M, 35C, and 35K. (hereinafter collectively referred to as the primary transfer rollers 35, unless otherwise specified.) The driving roller 32 is rotated in the counterclockwise direction by a motor or the like, and rotation of the driving roller 32 enables the intermediate transfer belt 31 to rotate in the same direction.

The intermediate transfer belt 31 is made of resin such as polyimide resin in which carbon is dispersed and has a thickness in a range of from 20 μm to 200 μm, preferably, approximately 60 μm. The volume resistivity thereof is in a range of from 1e6 Ωcm to 1e12 Ωcm, preferably, approximately 1e9 Ωcm. The volume resistivity is measured with the applied voltage of 100V by a high resistivity meter, Hiresta UPM-CPHT 45 manufactured by Mitsubishi Chemical Corporation.

The intermediate transfer belt 31 is interposed between the photoconductive drums 2 and the primary transfer rollers 35. Accordingly, a primary transfer nip is formed between the front surface of the intermediate transfer belt 31 and the photoconductive drums 2. The primary transfer rollers 35 are supplied with a primary bias by a transfer bias power source, thereby generating a transfer electric field between the toner images on the photoconductive drums 2 and the primary transfer rollers 35.

The toner image Y of yellow formed on the photoconductive drum 2Y enters the primary transfer nip as the photoconductive drum 2Y rotates. Subsequently, the toner image Y is transferred from the photoconductive drum 2Y to the intermediate transfer belt 31 by the transfer electrical field and the nip pressure. As the intermediate transfer belt 31 on which the toner image of yellow is transferred passes through the primary transfer nips of magenta, cyan, and black, the toner images on the photoconductive drums 2M, 2C, and 2K are superimposed on the toner image Y of yellow, thereby forming a composite toner image on the intermediate transfer belt 31 in the primary transfer process.

Each of the primary transfer rollers 35 is constituted of an elastic roller including a metal cored bar on which a conductive sponge layer is provided. The outer diameter thereof is approximately 16 mm. The diameter of the metal cored bar is approximately 10 mm. A resistance of the sponge layer is measured such that a metal roller having an outer diameter of 30 mm is pressed against the sponge layer at a load of 10 N and a voltage of 1000V is supplied to the metal cored bar of the primary transfer roller 35.

The resistance is obtained by Ohm's law R=V/I, where V is a voltage, I is a current, and R is a resistance. The obtained resistance R of the sponge layer is approximately 3E7Ω. The primary transfer rollers 35 described above are supplied with a primary transfer bias through a constant current control.

According to the illustrative embodiment, a roller-type primary transfer device is used as the primary transfer roller 35. Alternatively, a transfer charger and a brush-type transfer device may be employed as a primary transfer device.

The nip forming roller 36 of the transfer unit 30 is disposed outside the loop formed by the intermediate transfer belt 31, opposite the secondary-transfer rear roller 33. The intermediate transfer belt 31 is interposed between the secondary-transfer rear roller 33 and the nip forming roller 36, thereby forming a secondary transfer nip between the front surface of intermediate transfer belt 31 and the nip forming roller 36.

The nip forming roller 36 is grounded. The secondary-transfer rear roller 33 is supplied with a secondary transfer bias from a secondary transfer bias power source 39. With this configuration, a secondary transfer electric field is formed between the secondary-transfer rear roller 33 and the nip forming roller 36 so that the toner of negative polarity is transferred electrostatically from the secondary-transfer rear roller 33 side to the nip forming roller 36 side.

The sheet cassette 100 storing a stack of recording media sheets is disposed below the transfer unit 30. The sheet cassette 100 is equipped with a sheet feed roller 100*a* to contact a top sheet of the stack of recording media sheets. As the sheet feed roller 100*a* is rotated at a predetermined speed, the sheet feed roller 100*a* picks up the top sheet of the recording medium P and sends it to a sheet passage.

Substantially at the end of the sheet passage, the pair of registration rollers 101 is disposed. The pair of the registration rollers 101 stops rotating temporarily as soon as the recording medium P is interposed therebetween. The pair of registration rollers 101 starts to rotate again to feed the recording medium P to the secondary transfer nip in appropriate timing such that the recording medium P is aligned with the composite toner image formed on the intermediate transfer belt 31 in the secondary transfer nip. In the secondary transfer nip, the recording medium P tightly contacts the composite toner image on the intermediate transfer belt 31, and the composite toner image is transferred onto the recording medium P by the secondary transfer electric field and the nip pressure applied thereto. The recording medium P on which the composite color toner image is formed passes through the secondary transfer nip and separates from the nip forming roller 36 and the intermediate transfer belt 31.

The secondary-transfer rear roller 33 comprises a metal cored bar on which a conductive NBR rubber layer is provided. The outer diameter of the secondary-transfer rear roller 33 is approximately 24 mm. The diameter of the cored bar is approximately 16 mm. The resistance R of the conductive NBR rubber layer is in a range of from 1e6Ω to 1e12Ω, preferably, approximately 4e7Ω. The resistance R is measured using the same method as the primary transfer roller 35 described above.

The nip forming roller 36 comprises a metal cored bar on which a conductive NBR rubber layer is provided. The outer diameter of the nip forming roller 36 is approximately 24 mm. The diameter of the metal cored bar is approximately 14 mm. The resistance R of the conductive NBR rubber layer is equal to or less than 1e6Ω. The resistance R is measured using the same method as the primary transfer roller 35 described above.

The secondary transfer bias power source 39 includes a direct current power source and an alternating current power source, and can output an alternating current voltage superimposed on a direct current voltage as the secondary transfer bias. The output terminal of the secondary transfer bias power source 39 is connected to the metal cored bar of the secondary-transfer rear roller 33. The potential of the metal cored bar of the secondary-transfer rear roller 33 has almost the same value as the output voltage of the secondary transfer bias power source 39. Furthermore, the metal cored bar of the nip forming roller 36 is grounded.

Figure 3A:
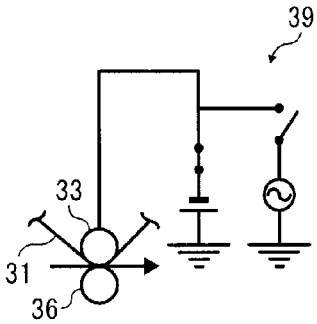
FIG. 3A is a schematic diagram illustrating a secondary-transfer rear roller supplied with a direct current (DC) voltage in the image forming apparatus.
Figure 3B:
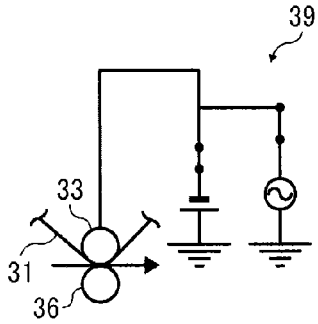
FIG. 3B is a schematic diagram illustrating the secondary-transfer rear roller supplied with an alternating current (AC) voltage superimposed on a direct current voltage.
Figure 3C:
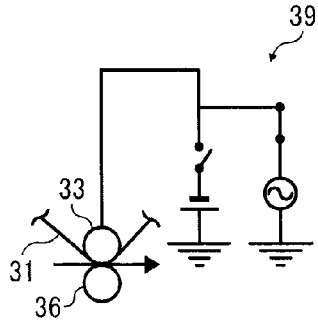
FIG. 3C is a schematic diagram illustrating the secondary-transfer rear roller supplied with an alternating current (AC) voltage.

With reference to FIGS. 3A through 3C, a description is provided of application of voltages to the secondary-transfer rear roller 33. FIG. 3A is a schematic diagram illustrating the secondary-transfer rear roller 33 supplied with a direct current (DC) voltage. FIG. 3B is a schematic diagram illustrating the secondary-transfer rear roller 33 supplied with an alternating current (AC) voltage superimposed on a direct current (DC) voltage. FIG. 3C is a schematic diagram illustrating the secondary-transfer rear roller 33 supplied with an alternating current (AC) voltage.

When using a normal sheet of paper, such as the one having relatively smooth surface, a pattern of dark and light according to the surface condition of the sheet does not appear. Thus, as illustrated in FIG. 3A, the transfer bias composed only of the direct current voltage is supplied. By contrast, when using a sheet having a rough surface, both the direct current power source and the alternating current power source are turned on as illustrated in FIG. 3B. Accordingly, the alternating current voltage superimposed on the direct current voltage is supplied to the secondary-transfer rear roller 33.

As will be described later, when a toner pattern such as a color gradation pattern, a line pattern group known as Chevron patches, and a toner consumption pattern passes through the secondary transfer nip, the direct current power source is turned off as illustrated in FIG. 3C so that only the alternating current voltage is supplied to the metal cored bar of the secondary-transfer rear roller 33.

Information on the recording medium such as whether the recording medium to be used is a normal sheet of paper or a recording medium having a rough surface may be input manually via a control panel by a user or selected from the control panel. In other words, the control panel serves as a sheet information detector.

According to the illustrative embodiment, the nip forming roller 36 is grounded while the superimposed bias is supplied to the metal cored bar of the secondary-transfer rear roller 33. Alternatively, the secondary-transfer rear roller 33 may be grounded while the superimposed bias is supplied to the metal cored bar of the nip forming roller 36. In this case, the polarity of the direct current voltage is changed.

More specifically, as illustrated in FIG. 3B, when the secondary-transfer rear roller 33 is supplied with the superimposed bias while the negative polarity toner is used and the nip forming roller 36 is grounded, the direct current voltage of the same negative polarity as the toner is used so that a time-averaged potential of the superimposed bias is the same negative polarity as the toner. By contrast, when the secondary-transfer rear roller 33 is grounded and the nip forming roller 36 is supplied with the superimposed bias, the direct current voltage of positive polarity, opposite the polarity of toner, is used so that the time-averaged potential of the superimposed bias is positive polarity opposite the polarity of toner.

Instead of supplying the superimposed bias to the secondary-transfer rear roller 33 and the nip forming roller 36, the direct current voltage may be supplied to one of the rollers, and the alternating current voltage may be supplied to the other roller.

Here, a sine wave alternating current voltage is used. Alternatively, a rectangular wave alternating current voltage may be used.

After the intermediate transfer belt 31 passes through the secondary transfer nip, residual toner not having been transferred onto the recording medium remains on the intermediate transfer belt 31. The residual toner is removed from the intermediate transfer belt 31 by the belt cleaning device 37 which contacts the surface of the intermediate transfer belt 31.

The cleaning backup roller 34 disposed inside the loop formed by the intermediate transfer belt 31 supports the cleaning operation by the belt cleaning device 37 from inside the loop of the intermediate transfer belt 31 so that the residual toner on the intermediate transfer belt 31 is removed reliably.

The electric potential detector 38 is disposed outside the loop formed by the intermediate transfer belt 31, opposite the driving roller 32 which is grounded. More specifically, the electric potential detector 38 faces a portion of the intermediate transfer belt 31 wound around the driving roller 32 with a gap of approximately 4 mm. The surface potential of a toner image primarily transferred onto the intermediate transfer belt 31 is measured when the toner image comes to the position opposite the electric potential detector 38. As the electric potential detector 38, a surface potential sensor EFS-22D manufactured by TDK Corp. is used.

On the right side of the secondary transfer nip formed between the secondary-transfer rear roller 33 and the intermediate transfer belt 31, the fixing device 90 is disposed. The fixing device 90 includes a fixing roller 91 and a pressing roller 92. The fixing roller 91 includes a heat source such as a halogen lamp inside thereof. While rotating, the pressing roller 92 pressingly contacts the fixing roller 91, thereby forming a heated area called a fixing nip therebetween.

The recording medium P bearing an unfixed toner image on the surface thereof is conveyed to the fixing device 90 and interposed between the fixing roller 91 and the pressing roller 92 in the fixing device 90. Under heat and pressure in the fixing nip, the toner adhered to the toner image is softened and fixed to the recording medium P. Subsequently, the recording medium P is discharged outside the image forming apparatus from the fixing device 90 along a sheet passage after fixing.

In a case of monochrome imaging, a support plate supporting the primary transfer rollers 35Y, 35M, and 35C of the transfer unit 30 is moved to separate the primary transfer rollers 35Y, 35M, and 35C from the photoconductive drums 2Y, 2M, and 2C. Accordingly, the front surface of the intermediate transfer belt 31, that is, the image bearing surface, is separated from the photoconductive drums 2Y, 2M, and 2C, so that the intermediate transfer belt 31 contacts only the photoconductive drum 2K. In this state, the image forming unit 1K is activated to form a toner image of black on the photoconductive drum 2K.

Figure 4:
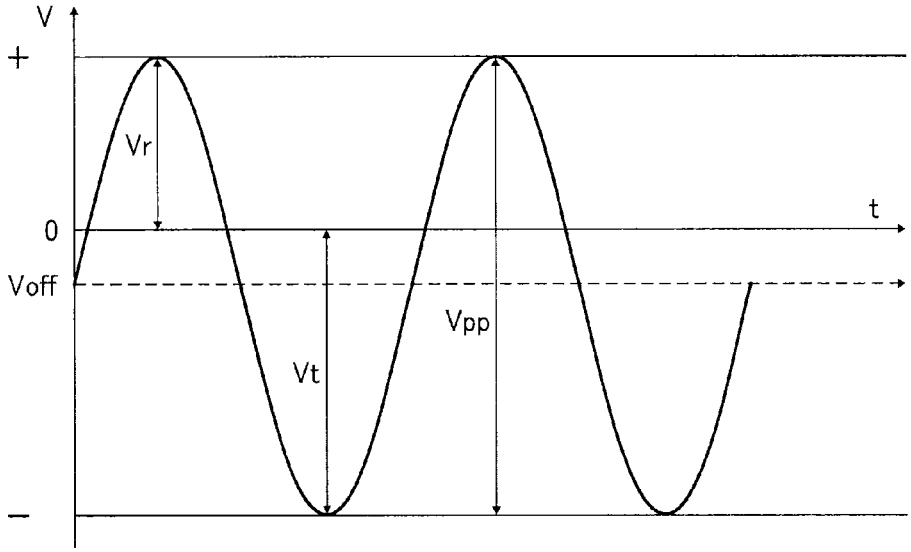
FIG. 4 is a waveform chart showing a waveform of a secondary transfer bias composed of a superimposed bias output from a secondary transfer bias power source in the image forming apparatus.

With reference to FIG. 4, a description is provided of the secondary transfer bias. FIG. 4 is a waveform chart showing a waveform of the secondary bias, which is a superimposed bias, output from the secondary transfer bias power source 39. As described above, the secondary transfer bias is supplied to the metal cored bar of the secondary-transfer rear roller 33. The secondary transfer bias power source 39 serves as a transfer bias applicator that supplies a transfer bias.

When the secondary transfer bias is supplied to the metal cored bar of the secondary-transfer rear roller 33, a potential difference is generated between the metal cored bar of the secondary-transfer rear roller 33 and the metal cored bar of the nip forming roller 36. In other words, the secondary transfer bias power source 39 serves also as a potential difference generator. In general, a potential difference is treated as an absolute value. However, according to the illustrative embodiment, the potential difference is treated as a value with polarity. More specifically, a value obtained by subtracting a potential of the metal cored bar of the nip forming roller 36 from a potential of the metal cored bar of the secondary-transfer rear roller 33 is considered as the potential difference.

When using the toner of negative polarity, if the time averaged value of the potential difference becomes negative, the potential of the nip forming roller 36 becomes greater than the potential of the secondary-transfer rear roller 33 on the opposite polarity side to the polarity of charged toner (the positive side in the present embodiment). Accordingly, the toner is electrostatically moved from the secondary-transfer rear roller side to the nip forming roller side.

In FIG. 4, an offset voltage Voff is a value of the direct current component of the secondary transfer bias. A peak-to-peak voltage Vpp is an alternating current component of the peak-to-peak voltage of the secondary transfer bias. According to the illustrative embodiment, the secondary transfer bias includes the superimposed voltage of the offset voltage Voff and the peak-to-peak voltage Vpp as described above. Thus, the time-averaged value of the superimposed voltage coincides with the value of offset voltage Voff.

As described above, according to the illustrative embodiment, the secondary transfer bias is supplied to the metal cored bar of the secondary-transfer rear roller 33 while the metal cored bar of the nip forming roller 36 is connected ground (0V). Thus, the potential of the metal cored bar of the secondary-transfer rear roller 33 becomes the potential difference between the potentials of the metal cored bar of the secondary-transfer rear roller and the metal cored bar of the nip forming roller. The potential difference between the potentials of the metal cored bar of the secondary-transfer rear roller and the metal cored bar of the nip forming roller includes a direct current component (Eoff) having the same value as the offset voltage Voff and an alternating current component (Epp) having the same value as the peak-to-peak voltage (Vpp).

According to the illustrative embodiment, as illustrated in FIG. 4, a negative voltage is used as the offset voltage Voff. When the polarity of the offset voltage Voff of the secondary transfer bias supplied to the secondary-transfer rear roller 33 is negative, the toner of negative polarity can be relatively forced from the secondary-transfer rear roller side 33 to the nip forming roller 36 side. If the polarity of the secondary transfer bias is negative so is the polarity of the toner, the toner of negative polarity is forced electrostatically from the secondary-transfer rear roller side 33 to the nip forming roller 36 side in the secondary transfer nip. Accordingly, the toner on the intermediate transfer belt 31 is transferred onto the recording medium P.

By contrast, if the polarity of the secondary transfer bias is opposite to the polarity of toner, that is, the polarity of the secondary transfer bias is positive, the toner of negative polarity is drawn electrostatically to the secondary-transfer rear roller 33 side from the nip forming roller 36 side. Consequently, the toner transferred to the recording medium P is drawn again to the intermediate transfer belt 31.

It is to be noted that because the time-averaged value of the secondary transfer bias (the same value as the offset voltage Voff in the present embodiment) is of negative polarity, relatively, the toner is forced electrostatically from the secondary-transfer rear roller 33 side to the nip forming roller 36 side. In FIG. 4, a return peak potential Vr represents a positive peak value having the opposite polarity to that of the toner.

According to the illustrative embodiment, the secondary transfer bias is set to satisfy "$\frac{1}{4}\times Vpp>|Voff|$" as the potential difference between the potentials of the metal cored bar of the secondary-transfer rear roller 33 and the nip forming roller 36. With this configuration, a sufficient density of toner is obtained at recessed portions on the surface of the recording medium, and hence the light-and-dark pattern according to the surface roughness is prevented from appearing.

According to the illustrative embodiment, the electric potential detector 38 measures a potential Vtoner of the composite toner image transferred on the intermediate transfer belt 31. Based on the result, the controller of the image forming apparatus obtains a potential difference that satisfies "$\frac{1}{4}\times Vpp>|Voff|$" and greater than the potential of toner image Vtoner on the opposite polarity side to the polarity of the charged toner. Accordingly, the secondary transfer bias (superimposed bias) having the obtained result is output.

Figure 5:
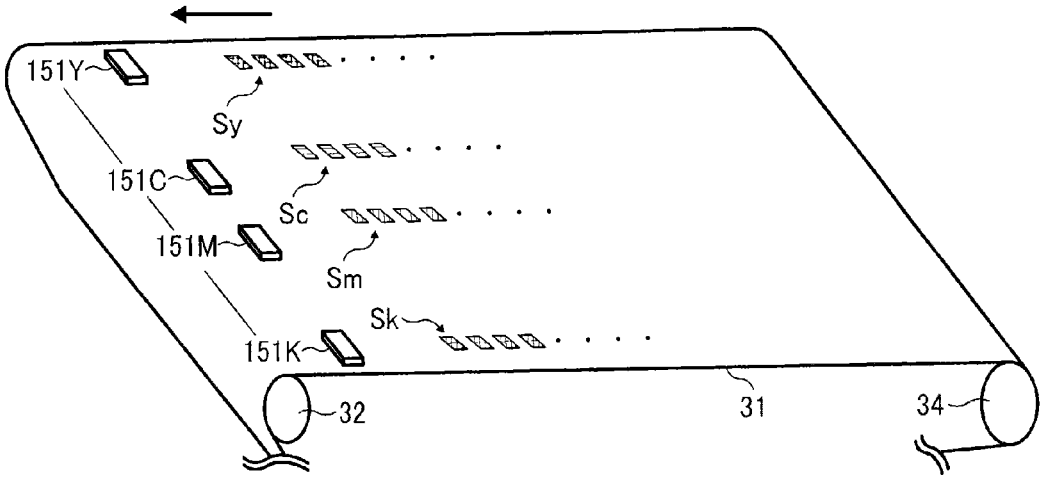
FIG. 5 is a schematic diagram illustrating gradation patterns formed on an intermediate transfer belt and optical detectors.

With reference to FIG. 5, a description is provided of optimization of image density. FIG. 5 is a schematic diagram illustrating gradation patterns and optical detectors 151. According to the illustrative embodiment, upon application of power or at every predetermined printing operation, the image forming apparatus may be subjected to image density control to optimize the density of each color.

The image density control includes forming the gradation patterns Sk, Sm, Sc, and Sy, one for each of the colors black, magenta, cyan, and yellow, respectively, on the intermediate transfer belt 31. The gradation patterns are formed opposite the optical detectors 151K, 151M, 151C, and 151Y (hereinafter collectively referred to as optical detectors 151) which detect the toner images. Each gradation pattern comprises ten toner patches each having a different image density and an area of 2 cm×2 cm.

When forming the gradation patterns Sk, Sm, Sc, and Sy, the surface potentials of the photoconductive drums 2K, 2M, 2C, and 2Y are gradually increased, in contrast to the normal printing process in which the surface potentials are kept constant. More specifically, multiple electrostatic latent image patches are formed on the photoconductive drums 2Y, 2M, 2C, and 2K by laser light scanning and then developed into toner patches by the developing devices 8. When developing the electrostatic latent image patches into toner patches, the developing bias applied to the developing rollers is gradually increased. As a result, gradation patterns of yellow, magenta, cyan, and black are formed on the respective photoconductive drums 2Y, 2M, 2C, and 2K.

The gradation patterns are then primarily transferred onto the intermediate transfer belt 31 at predetermined intervals in the main scanning direction. Each toner patch includes the toner in an amount of 0.1 mg/cm$^2$ to 0.55 mg/cm$^2$. When a toner Q/d distribution is measured, toner particles in each toner patch substantially have normal polarity.

The gradation patterns Sk, Sm, Sc, and Sy formed on the intermediate transfer belt 31 pass the positions facing the respective optical detectors 151 as the intermediate transfer belt 31 endlessly moves. The optical detectors 151 receive light in an amount corresponding to the toner amount per unit area in each toner patch.

Subsequently, the toner amount in each toner patch is calculated from the output voltage from the optical detectors 151 and a conversion algorithm when the optical detectors 151 detect the toner patch. Imaging conditions are adjusted based on the calculated toner amounts. More specifically, the toner amounts in toner patches detected by the optical detectors 151 and the developing potentials at developing the toner patches are compiled and subjected to a linear regression analysis to define a function ($y=ax+b$). The optimum developing bias for each color is obtained by substituting a desired image density into the function.

The memory of the image forming apparatus stores an imaging condition data table correlating several tens of developing bias values with their optimum charge potentials of the photoconductive drums. Each of the processing units 1Y, 1M, 1C, and 1K selects a developing bias value closest to the target developing bias from the imaging condition data table to determine the optimum charge potential of each photoconductive drum.

Figure 6:
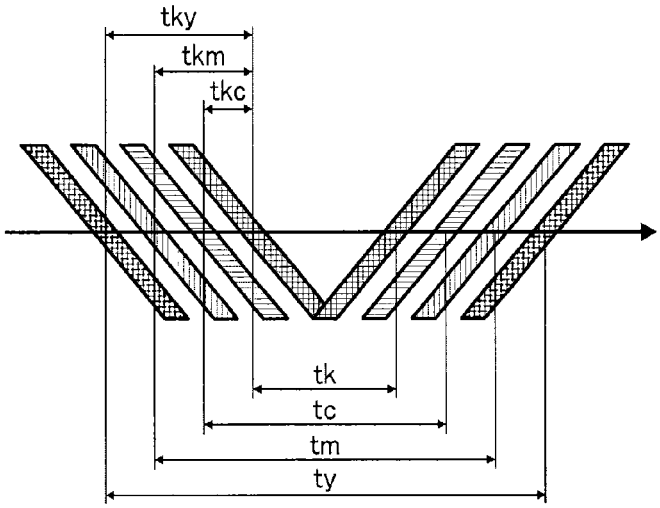
FIG. 6 is an enlarged diagram schematically illustrating a line pattern group known as Chevron patches formed on the intermediate transfer belt.

According to the illustrative embodiment, upon application of power or every predetermined printing operation, the image forming apparatus is subjected to correction of color deviation. In the color deviation correction, a color deviation detecting image, i.e., a Chevron patch as illustrated in FIG. 6, is formed on both ends of the intermediate transfer belt 31 in the width direction. The Chevron patch is comprised of linear toner images of yellow, magenta, cyan, and black, each slanted approximately 45° relative to the main scanning direction and arranged at predetermined intervals in the direction of movement of the intermediate transfer belt 31 (i.e., the sub-scanning direction). The Chevron patch includes toner in an amount of approximately 0.3 mg/cm$^2$.

Upon detection of the toner images in the Chevron patches on both ends of the intermediate transfer belt 31 in the width direction, the position in the main scanning direction (i.e., the axial direction of the photoconductive drum), the position in the sub-scanning direction (i.e., the direction of movement of the intermediate transfer belt 31), the magnification error in the main scanning direction, and the skew from the main scanning direction are detected with respect to each of the toner images.

The main scanning direction coincides with a direction in which a light beam changes its phase on the photoreceptor upon reflection by a polygon mirror. Detection time differences tky, tkm, and tkc between detection of the black toner image and detection of the yellow, magenta, and cyan toner images, respectively, in the Chevron patch, are determined from the optical detectors 151. In FIG. 6, the main scanning direction coincides with the vertical direction. In the Chevron patch, a set of toner images of yellow, magenta, cyan, and black arranged in this order from the left and another set of toner images of black, cyan, magenta, and yellow aligned in this order from the left, slanted 90° from the former set of toner images, are arranged side by side.

An amount of deviation in the sub-scanning direction, i.e., an amount of registration deviation, with respect to each of the toner images is obtained based on the differences between the actual and theoretical values of the detection time differences tky, tkm, and tkc relative to the detection time for the black toner image. Based on the amount of registration deviation, the timing for optically writing an image on the photoconductive drum 2 is adjusted with respect to every other face of the polygon mirrors, that is, per scanning line pitch, so that registration deviation is suppressed. The skew from the main scanning direction with respect to each of the toner images is determined based on the difference in the deviation amount in the sub-scanning direction between both ends of the intermediate transfer belt 31. Optical face tangle error correction is performed based on the measured skew to reduce skew deviation.

In summary, in the color deviation correction, the timings of optical writing and optical face tangle error are corrected based on the detection times of the toner images in the Chevron patch, so that registration and skew deviations are suppressed. With this configuration, even when the positions on the intermediate transfer belt 31 at which toner images are formed change over time due to changes in the temperature, color deviation is reduced, if not prevented entirely, by the above-described color deviation correction.

When an image with a low image area ratio is continuously produced, spent toner particles are gradually increased and accumulated in the developing devices 8. Such spent toner particles have poor chargeability. This leads to developing and transfer failures. To solve this problem, the printer can execute a refresh mode in which spent toner particles are forcibly discharged from the developing devices 8 to non-image areas on the photoconductive drum 2 at certain intervals and fresh toner particles are supplied to the developing devices 8.

The controller stores data regarding consumption of toner and operation time in the developing devices 8. Thus, the controller checks at a predetermined timing whether toner consumption within a predetermined operation time period is subthreshold or not in each of the developing devices 8, and then executes the refresh mode only in the developing device in which the toner consumption is subthreshold.

In the refresh mode, a toner consuming pattern is formed on the non-image area, corresponding to the area between successive sheets, on each of the photoconductive drums 2, according to the toner consumption per unit operation time. The toner consuming patterns of each color are transferred onto the intermediate transfer belt 31. The amount of toner in the toner consuming pattern is determined based on the toner consumption in a certain operation time period of the developing device 8. The maximum amount of toner per unit area may be approximately 1.0 $mg/cm^2$. When measuring the toner Q/d distribution of the toner consuming pattern having been transferred onto the intermediate transfer belt 31, toner particles substantially have normal polarity.

The gradation patterns, the Chevron patches, and the toner consuming patterns on the intermediate transfer belt 31 that are not transferred are also collected by the belt cleaning device 37. The belt cleaning device 37 may need to remove a large amount of toner from the intermediate transfer belt 31. However, the cleaning device using a cleaning blade may not adequately remove the gradation patterns, the Chevron patches, and the toner consuming patterns on the intermediate transfer belt 31 at once. In such a case, the toner remaining on the intermediate transfer belt 31 is transferred undesirably onto a recording medium in the subsequent printing operation. As a result, the output image contains an undesirable image.

To counteract such a problem, according to an illustrative embodiment, as the toner pattern passes through the secondary transfer nip, the power source for the direct current voltage is turned off as illustrated in FIG. 3C so that the charge eliminating bias composed only of the alternating current voltage is supplied to the secondary-transfer rear roller 33.

Figure 7:
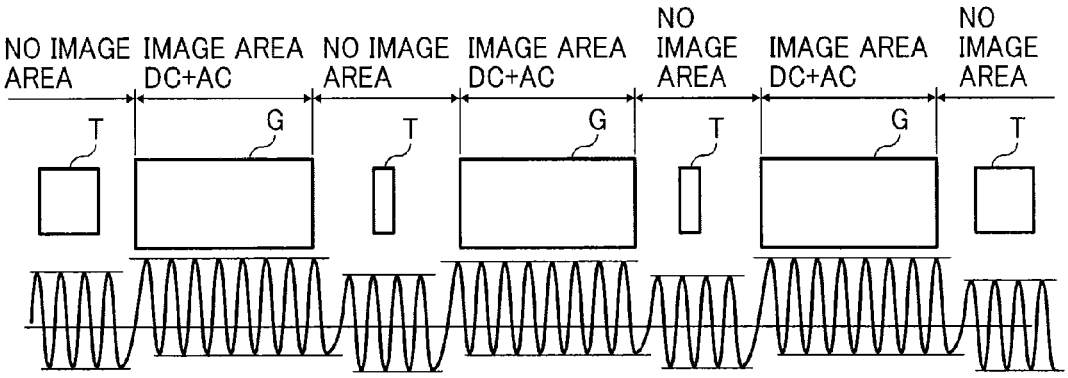
FIG. 7 is a chart showing changes in a voltage when a toner pattern passes through a secondary transfer nip, and when an image to be transferred to a recording medium passes through the secondary transfer nip.

With reference to FIG. 7, a description is provided of removal of toner patterns from the intermediate transfer belt 31. FIG. 7 is a chart showing a voltage supplied to the secondary-transfer rear roller 33 when a toner pattern T passes through the secondary transfer nip, and a voltage supplied to the secondary-transfer rear roller 33 when an image G to be transferred to the recording medium P passes through the secondary transfer nip.

As illustrated in FIG. 7, as the toner pattern T formed at the non-image area (between successive sheets) on the intermediate transfer belt 31 passes through the secondary transfer nip, the power source for the direct current voltage is turned off so that the charge eliminating bias composed only of the alternating current voltage is supplied to the secondary-transfer rear roller 33. With this configuration, the charge of the toner in the toner pattern T charged at a certain voltage is reduced to almost 0V. As a result, the toner in the toner pattern is prevented from adhering electrostatically to the intermediate transfer belt 31, thereby facilitating removal of the toner pattern from the intermediate transfer belt 31 using the cleaning blade of the belt cleaning device 37.

When the image to be transferred onto the recording medium passes through the secondary transfer nip, the transfer bias including the alternating current voltage superimposed on the direct current voltage that satisfies "$\frac{1}{4}\times Vpp>|Voff|$" is supplied to the secondary-transfer rear roller 33.

The peak-to-peak voltage of the alternating current voltage of the charge eliminating bias may be greater than the peak-to-peak voltage of the alternating current voltage of the transfer bias. With this configuration, the charge of the toner in the toner pattern is reliably removed at the secondary transfer nip.

Figure 8:
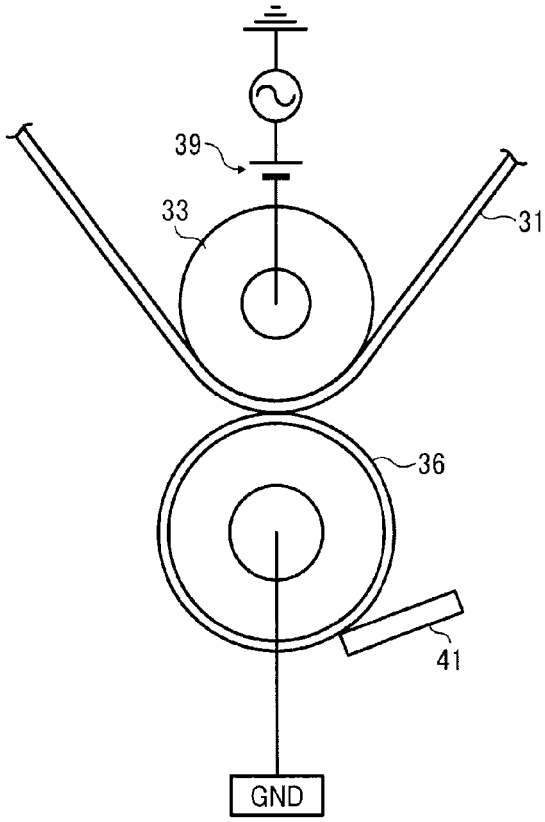
FIG. 8 is an enlarged diagram schematically illustrating a nip forming roller provided with a cleaning blade.

With reference to FIG. 8, a description is provided of a cleaning device for cleaning the nip forming roller 36. FIG. 8 is an enlarged diagram schematically illustrating a cleaning blade 41 serving as the cleaning device to remove paper dust and toner from the nip forming roller 36.

When provided with the cleaning blade 41, a charge eliminating bias that can transfer a portion of toner in the toner pattern to the nip forming roller 36 may be supplied to the secondary-transfer rear roller 33. More specifically, the charge eliminating bias in which the alternating current voltage and the direct current voltage are superimposed is supplied. The direct current voltage is smaller than the direct current component of the secondary transfer bias. Accordingly, the toner in the toner pattern is transferred to the nip forming roller 36 by the superimposed direct current voltage.

Since the value of the direct current voltage is less than the direct current voltage of the secondary transfer bias, not all toner in the toner pattern is transferred to the secondary-transfer rear roller, but a portion of the toner is transferred to the nip forming roller 36. Thus, the amount of toner to be removed by the belt cleaning device 37 can be reduced so that the belt cleaning device 37 can reliably remove the toner pattern. The toner transferred to the nip forming roller 36 is removed by the cleaning blade 41.

In a case in which the toner pattern is not formed at the non-image area (i.e. between successive sheets), both power sources for the alternating current voltage and the direct current voltage are turned off so that no bias is supplied to the secondary-transfer rear roller 33. Alternatively, the secondary transfer bias may be supplied to the secondary-transfer rear roller 33.

The foregoing descriptions relate to the secondary transfer nip defined by the intermediate transfer belt 31 contacting the nip forming roller 36. Alternatively, the secondary transfer nip may be formed by the intermediate transfer belt 31 contacting another belt formed into an endless loop. In this case, a pressing roller is disposed inside the looped belt to press against the metal cored bar of the secondary-transfer rear roller 33 disposed inside the looped intermediate transfer belt 31. The secondary transfer bias and the charge eliminating bias are supplied to the nip.

The present invention relates to the transfer nip at which the intermediate transfer belt 31 serving as an image bearing member contacts the nip forming roller 36. Furthermore, the present invention may relate to a transfer nip with the following configuration. For example, a contact member contacts a rear surface of a belt-type photoconductor serving as an image bearing member so as to press the photoconductor against a nip forming member disposed opposite the contact member, thereby forming a transfer nip.

Figure 9:
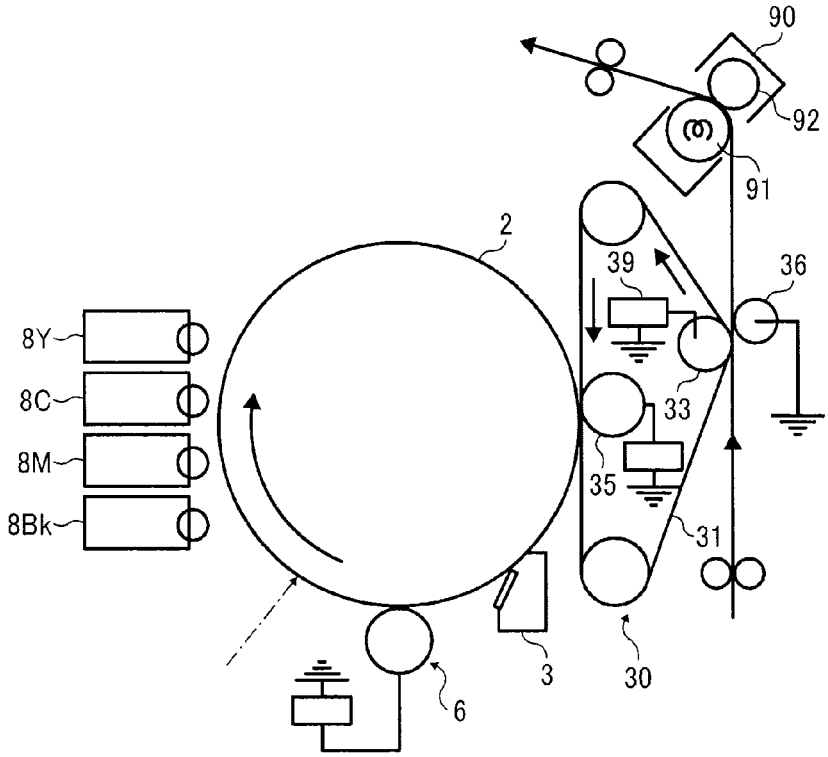
FIG. 9 is a schematic diagram illustrating an image forming apparatus according to another illustrative embodiment of the present invention.

Furthermore, the present invention can be applied to an image forming apparatus such as shown in FIG. 9. FIG. 9 is a schematic diagram illustrating another example of an image forming apparatus in which the present invention can be implemented. The image forming apparatus illustrated in FIG. 9 is a printer and includes one photoconductive drum 2 surrounded by the charging device 6, the drum cleaner 3, the developing devices 8Y, 8C, 8M, and 8K, and the transfer unit 30.

When forming an image, the surface of the photoconductive drum 2 is charged uniformly by the charging device 6. Subsequently, the surface of the photoconductive drum 2 is illuminated with a modulated light beam based on image data associated with the color yellow. An electrostatic latent image for yellow is formed on the surface of the photoconductive drum 2. Subsequently, the electrostatic latent image is developed into a toner image of yellow with toner by the developing device 8Y and transferred primarily onto the intermediate transfer belt 31.

After transfer, there may be some toner left on the surface of the photoconductive drum 2. Such residual toner is removed from the photoconductive drum 2 by the drum cleaner 3. After cleaning, the photoconductive drum 2 is charged uniformly again by the charging device 6 in preparation for the subsequent imaging cycle. Next, the surface of the photoconductive drum 2 is illuminated with a modulated light beam based on image data for magenta to form an electrostatic latent image of magenta on the surface thereof. The developing device 8M develops the electrostatic latent image with toner of magenta, forming a toner image of magenta. The toner image of magenta is transferred on top of the toner image of yellow.

Similar to the toner images of yellow and magenta, electrostatic latent images of cyan and black are formed and developed into toner images of cyan and black on the respective photoconductive drums 2. The toner images of cyan and black are transferred onto the intermediate transfer belt 31 so that they are superimposed one atop the other over the toner image of magenta on the toner image of yellow. Accordingly, a composite color toner image is formed on the intermediate transfer belt 31.

Subsequently, the composite toner image on the intermediate transfer belt 31 is transferred onto the recording medium in the secondary transfer nip and fixed by the fixing device 90. After fixing the composite toner image, the recording medium is discharged outside the image forming apparatus.

The image forming apparatus of the present embodiment may include the secondary transfer power source 39.

Figure 10:
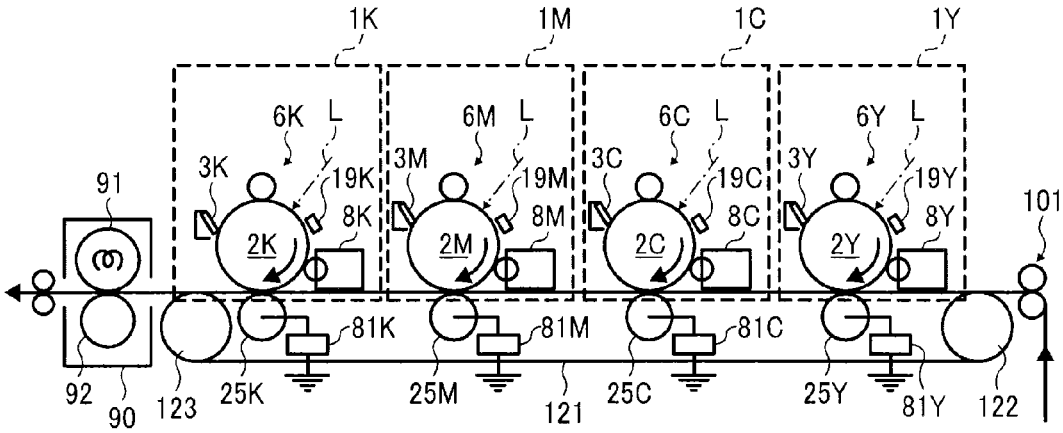
FIG. 10 is a schematic diagram illustrating an image forming apparatus according to still another illustrative embodiment of the present invention.

With reference to FIG. 10, a description is provided of an image forming apparatus according to another illustrative embodiment of the present invention. Unless otherwise specified, the same reference numerals are given to constituent elements such as parts and materials having the same functions as the foregoing embodiments, and redundant descriptions thereof omitted.

FIG. 10 is a schematic diagram illustrating a printer as an example of an image forming apparatus according to another illustrative embodiment of the present invention. According to the present embodiment, a sheet transport belt 121 formed into an endless loop contacts the photoconductive drums 2Y, 2C, 2M, and 2K, thereby forming transfer nips therebetween. The sheet transport belt 121 rotates while carrying the recording medium on the surface thereof to pass through the transfer nips. When the recording medium passes through the transfer nips, the toner images of yellow, magenta, cyan, and black on the photoconductive drums 2Y, 2C, 2M, and 2K, respectively, are transferred onto the recording medium such that they are superimposed one atop the other. Accordingly, a composite color toner image is formed on the recording medium.

The image forming units 1Y, 1M, 1C, and 1K include electric potential detectors 19Y, 19C, 19M, and 19K, each facing a respective one of the plurality of the photoconductive drums 2Y, 2C, 2M, and 2K, to detect potentials of the electrostatic latent images formed on the photoconductive drums 2Y, 2C,2M, and 2K. A surface potential sensor EFS-22D manufactured by TDK Corp. is used as the electric potential detectors 19Y, 19C, 19M, and 19K. The electric potential detectors 19Y, 19C, 19M, and 19K each face the respective one of the photoconductive drums 2Y, 2C, 2M, and 2K with a gap, approximately 4 mm.

Transfer rollers 25Y, 25C, 25M, and 25K are disposed inside the loop formed by the sheet transport belt 121 and pressingly contact the rear surface the sheet transport belt 121 against the photoconductive drums 2Y, 2C, 2M, and 2K. According to the present embodiment, the charging devices 6Y, 6C, 6M, and 6K, the optical writing unit, and the transfer rollers 25Y, 25C, 25M, and 25K constitute a potential difference generator. The charging devices 6 charge the photoconductive drums 2.

After charging the photoconductive drums 2, the optical writing unit optically writes an image on the photoconductive drums 2, thereby forming electrostatic latent images on the photoconductive drums 2. The potential difference generator generates a potential difference including a direct current component and an alternating current component between the electrostatic latent images on the photoconductive drums 2 and the metal cored bar of the transfer rollers 25 serving as pressing members.

In the present embodiment, the sheet transport belt 121 contacts the photoconductive drums 2Y, 2C, 2M, and 2K. Alternatively, the transfer rollers 25Y, 25C 25M, and 25K may contact directly the photoconductive drums 2Y, 2M, 2C, and 2K, respectively, to form primary transfer nips therebetween. In this case, each of the transfer rollers 25Y, 25C, 25M, and 25K serve as the nip forming member.

Transfer bias power sources 81Y, 81C, 81M, and 81K supply a transfer bias to the transfer rollers 25Y, 25C, 25M, and 25K so that a potential difference is generated between the electrostatic latent images on the photoconductive drums 2Y, 2C, 2M, and 2K, and the metal cored bars of the transfer rollers 25Y, 25C, 25M, and 25K. More specifically, the transfer bias output from the transfer bias power sources 81Y, 81C, 81M, and 81K satisfies the relation "$\frac{1}{4}\times Vpp|Voff|$", wherein Vpp represents the alternating current component of the peak-to-peak voltage and Voff represents the time-averaged value of the potential difference while the potential of the metal cored bars of the transfer rollers 25Y, 25M, 25C, and 25K is greater than the potential of the electrostatic latent images of the photoconductive drums 2Y, 2C, 2M, and 2K on the opposite polarity side to the polarity of charged toner.

The controller of the image forming apparatus measures the potential of the latent image at specific times, such as after the power is turned on, during stand-by, and when continuous printing is temporally stopped. More specifically, in the latent image potential measuring process, first, patch-shaped electrostatic latent images having a size of 1 cm×1 cm are formed on the photoconductive drums 2Y, 2C, 2M, and 2K, and the potentials of the patch-shaped electrostatic latent images are detected by the potential detectors 19Y, 19C, 19M, and 19K. Then, the detection results are stored in a data storage unit such as a RAM.

Based on the potentials of the patch-shaped electrostatic latent images on the photoconductive drums 2Y, 2C, 2M, and 2K provided by the controller, the transfer bias power sources 81Y, 81C, 81M, and 81K calculate the potential differences that satisfy the relation "$\frac{1}{4}\times Vpp|Voff|$", and make the potentials of the metal cored bars of the transfer rollers greater on the opposite polarity side to the charged polarity of the toner than the potentials of the patch-shaped electrostatic latent images. Subsequently, the transfer bias power sources 81Y, 81C, 81M, and 81K output transfer biases (superimposed biases) that satisfy the calculation results.

Similar to the foregoing embodiments, the controller checks at a predetermined timing whether toner consumption within a predetermined operation time period is subthreshold or not in each of the developing devices 8Y, 8C, 8M, and 8K, and then executes the refresh mode only in the developing device in which the toner consumption is subthreshold.

Subsequently, the toner consumption patterns are formed on the photoconductive drums 2 as toner patterns. As the toner consumption patterns pass through the transfer nips, the charge eliminating bias described above is supplied to remove the charge from the toner in the toner consumption patterns. With this configuration, the electrostatic adhesive force of the toner adhering to the photoconductive drums 2 is reduced, thereby facilitating removal of the toner consumption patterns from the photoconductive drums 2 using cleaning blades of drum cleaners 3Y, 3C, 3M, and 3K.

According to the illustrative embodiments, as the toner pattern passes through the secondary transfer nip, the secondary transfer bias power source 39 supplies the charge eliminating bias to the secondary-transfer rear roller 33 to remove charge from the toner in the toner pattern. As a result, the adhesive force of the toner adhering electrostatically to the intermediate transfer belt 31 is reduced, thereby removing reliably toner on the intermediate transfer belt 31 by the belt cleaning device 37.

As described above, because the charge eliminating bias is composed only of an alternating current component, the charge of the toner in the toner pattern is reduced to substantially 0V.

When equipped with the secondary transfer cleaning blade 41 serving as the cleaning device for cleaning the nip forming roller 36, the charge eliminating bias may be composed of a superimposed voltage in which an alternating current voltage and the direct current voltage are superimposed and the direct current voltage is less than the direct current voltage of the secondary transfer bias. With this configuration, the charge of the toner in the toner pattern can be reduced by the alternating current voltage while transferring a portion of the toner in the toner pattern to the nip forming roller 36 which is then cleaned by the secondary transfer cleaning blade 41. Thus, the amount of toner to be removed by the belt cleaning device 37 can be reduced, thereby reliably removing the toner pattern by the cleaning device 37.

Furthermore, the peak-to-peak voltage of the alternating current component of the charge eliminating bias is greater than the peak-to-peak voltage of the alternating current component of the transfer bias so that the charge of the toner can be reduced more effectively.

The secondary transfer bias power source 39 supplies a secondary transfer bias in which the peak-to-peak voltage of the alternating current component is 4 times greater than an absolute value of the voltage of the direct current component. With this configuration, a sufficient amount of toner is transferred to recessed portions of the surface of the recording medium, and hence the light-and-dark pattern according to the surface roughness is prevented from appearing.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearing member to bear a toner image and a toner pattern comprising toner not to be transferred onto a sheet;

a nip-forming member to form a transfer nip between the image bearing member and the nip-forming member;

a cleaning device to remove toner remaining on the image bearing member; and a power source to output a first bias in which an alternating current component and a direct current component are superimposed to transfer the toner image onto the sheet at the transfer nip, the power source outputting a second bias composed only of an alternating current component when the toner pattern passes through the transfer nip.

2. The image forming apparatus according to claim 1, further comprising a photoconductive drum on which the toner image and the toner pattern are formed, wherein the image bearing member is an intermediate transfer belt on which the toner image and the toner pattern are transferred from the photoconductive drum.

3. The image forming apparatus according to claim 1, wherein the nip-forming member is a roller.

4. The image forming apparatus according to claim 1, wherein the image bearing member is a photoconductive drum on which the toner image and the toner pattern are formed.

5. The image forming apparatus according to claim 1, wherein the nip-forming member is a sheet transport belt.

6. The image forming apparatus according to claim 1, wherein the cleaning device includes a cleaning blade.

7. The image forming apparatus according to claim 1, further comprising a second cleaning blade to remove toner remaining on the nip-forming member.

8. The image forming apparatus according to claim 1, wherein the image bearing member bears the toner pattern, which includes a plurality of toner patches, each having a different image density.

9. The image forming apparatus according to claim 1, wherein the image bearing member bears the toner pattern, which includes a patch for correction of color deviation.

10. The image forming apparatus according to claim 1, wherein the image bearing member bears the toner pattern, which includes a toner consuming pattern.

11. An image forming apparatus, comprising:

an image bearing member to bear a toner image and a toner pattern comprising toner not to be transferred onto a sheet;

a nip-forming member to form a transfer nip between the image bearing member and the nip-forming member;

a cleaning device to remove toner remaining on the image bearing member; and a power source to output a first superimposed bias in which an alternating current component and a first direct current component are superimposed to transfer the toner image onto the sheet at the transfer nip, the power source outputting a second superimposed bias in which an alternating current component and a second direct current component are superimposed when the toner pattern passes through the transfer nip, wherein the second direct current component is smaller than the first direct current component.

12. The image forming apparatus according to claim 11, further comprising a photoconductive drum on which the toner image and the toner pattern are formed, wherein the image bearing member is an intermediate transfer belt on which the toner image and the toner pattern are transferred from the photoconductive drum.

13. The image forming apparatus according to claim 11, wherein the nip-forming member is a roller.

14. The image forming apparatus according to claim 11, wherein the image bearing member is a photoconductive drum on which the toner image and the toner pattern are formed.

15. The image forming apparatus according to claim 11, wherein the nip-forming member is a sheet transport belt.

16. The image forming apparatus according to claim 11, wherein the cleaning device includes a cleaning blade.

17. The image forming apparatus according to claim 11, further comprising a second cleaning blade to remove toner remaining on the nip-forming member.

18. The image forming apparatus according to claim 11, wherein the image bearing member bears the toner pattern, which includes a plurality of toner patches each having a different image density.

19. The image forming apparatus according to claim 11, wherein the image bearing member bears the toner pattern, which includes a patch for correction of color deviation.

20. The image forming apparatus according to claim 11, wherein the image bearing member bears the toner pattern, which includes a toner consuming pattern.

21. The image forming apparatus according to claim 11, wherein the first direct current component of the first superimposed bias has a same polarity as the second direct current component of the second superimposed bias.

22. The image forming apparatus according to claim 2, wherein the first bias and the second bias are output continuously by the power source.

23. The image forming apparatus according to claim 22, wherein the power source outputs the second bias when the toner pattern formed at an area between successive sheets passes through the transfer nip.

24. The image forming apparatus according to claim 2, wherein a peak-to-peak voltage of the second bias is greater than that of the first bias.

25. The image forming apparatus according to claim 11, wherein the first superimposed bias and the second superimposed bias are output continuously by the power source.

26. The image forming apparatus according to claim 25, wherein the power source outputs the second superimposed bias when the toner pattern formed at an area between successive sheets passes through the transfer nip.

27. The image forming apparatus according to claim 11, wherein a peak-to-peak voltage of the second superimposed bias is greater than that of the first superimposed bias.

* * * * *